United States Patent [19]

Cox et al.

[11] Patent Number: 4,898,477

[45] Date of Patent: Feb. 6, 1990

[54] SELF-EXPANDING FLEXIBLE POUCH

[75] Inventors: William A. Cox; James B. Camden, both of Cincinnati; George L. Roseberry, Fairfield, all of Ohio

[73] Assignee: The Procter & Gamble Company, Cincinnati, Ohio

[21] Appl. No.: 259,380

[22] Filed: Oct. 18, 1988

[51] Int. Cl.[4] ..... B65D 33/00

[52] U.S. Cl. ..... 383/33; 383/104; 426/86; 426/115; 426/122

[58] Field of Search ..... 383/33, 34, 34.1, 61, 383/104; 426/86, 115, 122; 150/900

[56] References Cited

U.S. PATENT DOCUMENTS

| | | | |
|---|---|---|---|
| 1,338,375 | 4/1920 | Kleidman . | |
| 1,403,414 | 1/1922 | Hohein . | |
| 1,413,079 | 4/1922 | Waid . | |
| 1,513,395 | 10/1924 | Holmes . | |
| 1,798,945 | 3/1931 | Lamarthe . | |
| 1,973,956 | 9/1934 | Hickman | 229/62 |
| 2,080,402 | 5/1937 | Herman | 206/41 |
| 2,093,976 | 9/1937 | Farmer | 229/62 |
| 2,150,627 | 3/1939 | Lieber | 150/10 |
| 2,158,955 | 5/1939 | Blacher | 150/10 |
| 2,227,390 | 12/1940 | Green | 150/10 |
| 2,232,888 | 2/1941 | Schimelmitz | 150/10 |
| 2,241,612 | 5/1941 | Norris | 150/3 |
| 2,498,202 | 2/1950 | Dingman | 150/5 |
| 2,654,892 | 10/1953 | Szabo . | |
| 2,792,168 | 5/1957 | Garcon | 229/65 |
| 2,873,905 | 2/1959 | Denton | 229/55 |
| 3,189,253 | 6/1965 | Mojonnier | 383/35 |
| 3,272,248 | 9/1966 | O'Farrell | 150/10 |
| 3,310,224 | 3/1967 | Laguerre | 229/54 |
| 3,334,804 | 8/1967 | Watts, Jr. | 229/53 |
| 3,346,883 | 10/1967 | Ersek | 4/1 |
| 3,380,646 | 4/1968 | Doyen et al. | 383/104 |
| 3,412,918 | 11/1968 | Sherman | 383/104 |
| 3,426,958 | 2/1969 | Gore | 229/53 |
| 3,463,381 | 8/1969 | Wainberg | 229/54 |
| 3,542,190 | 11/1970 | Keller | 426/86 |
| 3,635,376 | 1/1972 | Hellstrom | 222/107 |
| 3,734,154 | 5/1973 | Polk | 150/9 |
| 3,759,439 | 9/1973 | Cross et al. | 229/66 |
| 3,782,601 | 1/1974 | Krawagna | 222/107 |
| 3,790,744 | 2/1974 | Bowen | 219/121 LM |
| 3,817,434 | 6/1974 | Dickman | 383/33 |
| 3,909,582 | 9/1975 | Bowen | 219/121 LM |
| 4,141,399 | 3/1979 | Zoland | 383/104 |
| 4,196,034 | 4/1980 | Kimura | 383/104 |
| 4,317,478 | 3/1982 | Babbidge | 150/10 |
| 4,454,979 | 6/1984 | Ikeda et al. | 383/104 |
| 4,471,875 | 9/1984 | Hain et al. | 206/632 |
| 4,541,117 | 9/1985 | Ashbeck | 383/33 |
| 4,593,408 | 6/1986 | Drobish et al. | 383/43 |
| 4,621,000 | 11/1986 | Frick | 428/40 |
| 4,634,006 | 1/1987 | Yanase | 383/61 |
| 4,718,738 | 1/1988 | Bell | 383/104 |
| 4,756,917 | 7/1988 | Kamada et al. | 428/457 |

FOREIGN PATENT DOCUMENTS

| | | | |
|---|---|---|---|
| 0201257 | 11/1986 | European Pat. Off. | 206/634 |
| 2635366 | 3/1978 | Fed. Rep. of Germany | 383/104 |
| 0770209 | 9/1934 | France . | |
| 770209 | 9/1934 | France . | |

*Primary Examiner*—Stephen Marcus
*Assistant Examiner*—K. M. Stemann
*Attorney, Agent, or Firm*—John J. Ryberg; Thomas J. Slone; John V. Gorman

[57] ABSTRACT

A self-expanding flexible pouch that can be used as the measuring device for reconstituting a concentrated product contained therein. The flexible pouch includes an extensible stay located in the throat area of the pouch that is biased toward a circular or elliptical configuration but initially held substantially flat in a stressed condition by the pouch's sealed top portion. When the pouch's top portion is removed, the extensible stay expands to its unstressed circular configuration and thereby expands and opens the pouch's throat area. In a particularly preferred embodiment of the present invention, the pouch's bottom section is provided with a pleated bottom gusset panel that is attached to the sidewall panels' inner surface. When the reconstituting fluid is poured into the pouch, the pouch's bottom gusset panel unfolds and drops downward which allows the pouch's bottom section to also expand and assume a substantially tubular configuration. Also disclosed are various barrier laminates from which pouches of the present invention can be made which protect the pouch's contents from light, moisture, and air, and also resist the absorption of essential oils, flavoring components, and nutritional elements found in the product contained within the pouch.

27 Claims, 2 Drawing Sheets

Fig.1
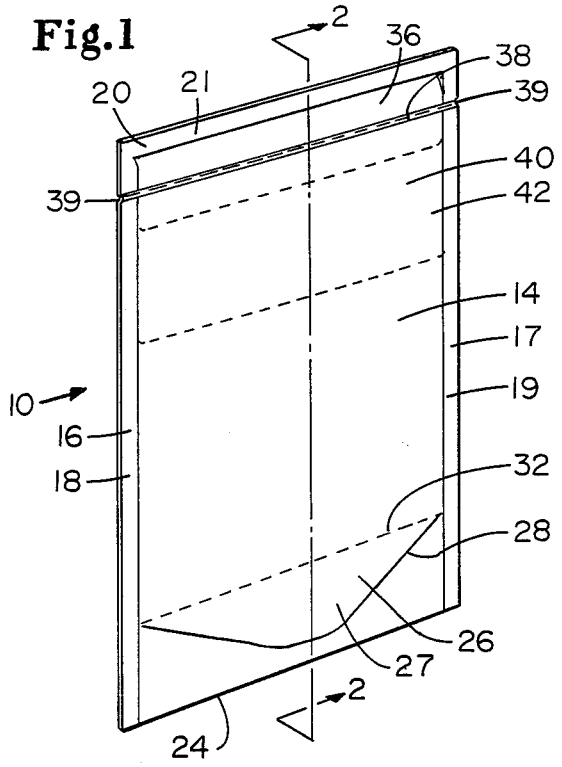
Fig. 2
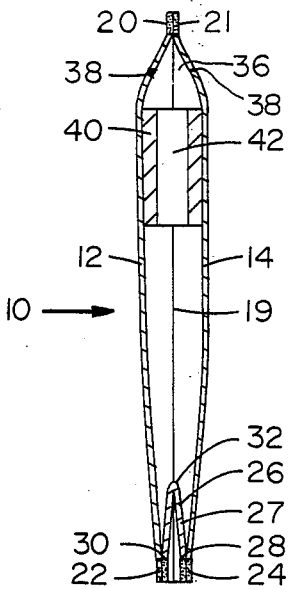
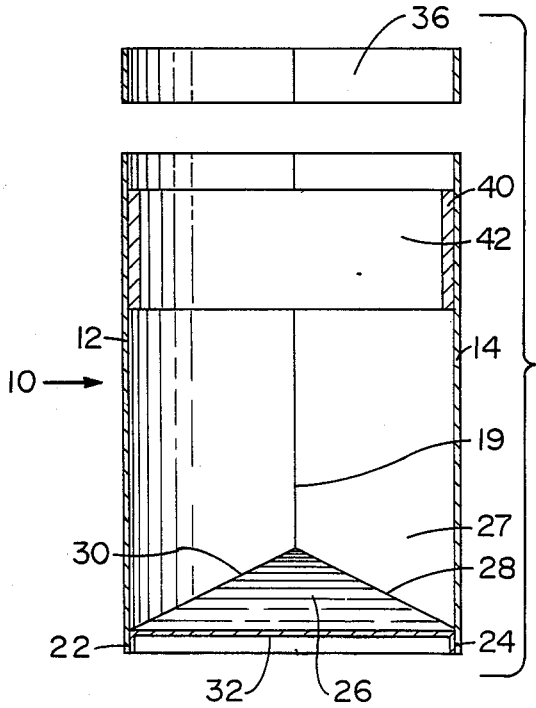
Fig.3
Fig. 4
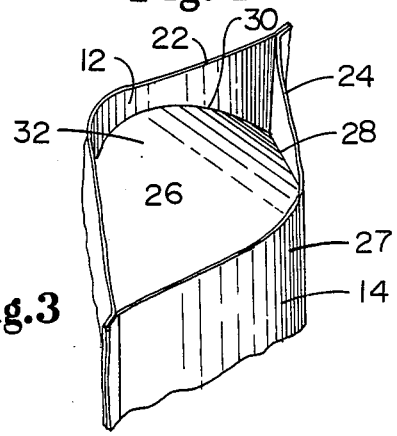

SELF-EXPANDING FLEXIBLE POUCH

TECHNICAL FIELD

The present invention relates to flexible packaging pouches, and more particularly relates to flexible pouches that expand after opening.

BACKGROUND OF THE INVENTION

Many products are shipped and sold in concentrated form to reduce shipping costs, storage space, and shelf space. For example, in the case of citrus juice and other beverages, it is cost effective to first concentrate the product by removing a substantial portion of the juice's water volume at the point of manufacture, and then ship it to the place of sale in concentrated form. From there, the consumer typically empties the beverage concentrate into a large container and reconstitutes the beverage by adding a prescribed amount of water. In other cases, products are concentrated by necessity to "deactivate" the product, and then reactivated at the point of end use by adding a solvent or other fluid, examples of which include latex cements and epoxy glues that set up and harden shortly after the activating fluid is added.

Many different types of containers are used to package concentrated products. For example, composite foil-fiber cans are widely used to package concentrated citrus and other fruit juices. However, these cans are not entirely satisfactory because they are relatively expensive to make, generally do not provide an adequate barrier to oxygen and moisture permeation, and tend to absorb some of the essential oils and critical flavoring components that are present in the beverage concentrate. In addition, foil-fiber cans are notoriously difficult to open with a can opener or by pulling the plastic strip located between the can's lid and body portion that is commonly used on some cans. Moreover, in the case of frozen concentrated beverages, it is difficult to remove the contents from a foil fiber can because the can's rigid sidewalls cannot be easily squeezed to "milk" the product out, thereby requiring the use of a spoon or other utensil to dig the frozen concentrate out of the can. One advantage of the foil fiber can, however, is that after the can's contents have been removed, it can be conveniently used as the means for accurately measuring the amount of water that needs to be added to the beverage concentrate for proper reconstitution because the can's rigidity gives it a constant, repeatable volume.

Citrus beverage concentrates are commonly packaged in 12 ounce (355 ml) foil-fiber cans that have instructions to fill the empty can with 3 volumes of water to make 48 ounces (1.42 l) of single strength beverage, i.e., a 3:1 reconstitution ratio. However, it has been found that even more concentrated citrus beverages are possible, e.g. 5:1, to further reduce shipping costs and storage space while still maintaining high quality standards. However, if a more concentrated form of the beverage, e.g. a 5:1 concentration ratio, is packaged in a foil fiber can to ultimately make 48 ounces of single strength beverage, then the can would initially hold 8 ounces (237 ml) of concentrate and yet need the ability to hold 13.3 ounces (393 ml) of fluid to maintain the "add three cans of water" routine that most consumers are familiar with. Obviously, a 13.3 ounce can that initially holds only 8 ounces of product would have a huge amount of headspace which would lead consumers to believe that some of the product was missing. If the headspace is reduced to a normal level, then an 8 ounce can that contains a 5:1 concentrated beverage would require 5 volumes of water to be added for proper reconstitution, which might confuse consumers and require a major habit change.

Some concentrated products, most notably powder or dry beverages and dehydrated foods, are packaged in pouches made of two superimposed flexible films that are simply sealed together about their peripheral edges and therefore relatively easy and inexpensive to make. However, it has been found that consumers generally do not use the empty pouch as the means for measuring the amount of fluid that needs to be added to the concentrated product, but instead use a separate device such as a rigid measuring cup. It is believed that this habit is primarily because such pouches are very flexible and therefore difficult to grasp and pour from with confidence when the pouch is full of fluid. In addition, since the sidewall panels of most pouches are very flexible, they will deform or collapse a substantial amount when grasped by a consumer, which significantly decreases and varies the amount of reconstituting fluid that the pouch will hold. Furthermore, in the case of liquid or semi-solid concentrated products, which are typically very viscous and sticky, the product causes the pouch's sidewalls to stick to one another when the pouch is opened, thereby requiring the consumer to insert his fingers or another instrument into the opened pouch to pry the pouch's sidewalls apart to gain access to the product.

In light of the above, a principle object of the present invention is to provide a flexible pouch for containing a concentrated product that can be used as the means for accurately measuring the amount of fluid that needs to be added to the concentrated product.

Another principle object of the present invention is to provide a flexible pouch that will assume a predetermined configuration upon opening.

Yet another object of the present invention is to provide a flexible pouch that exhibits superior barrier protection against light, moisture and oxygen.

Another object of the present invention is to provide a flexible pouch that resists the migration into and absorption by the pouch of essential oils and flavoring components found in the product contained therein.

Another object of the present invention is to provide a flexible pouch that will collapse when discarded and thereby reduce the volume of generated waste material.

A further object of the present invention is to provide a flexible pouch for containing a concentrated product that is sufficiently rigid and stable enough to allow a consumer to firmly grasp and pour a fluid from the pouch with confidence.

Another object of the present invention is to provide a flexible pouch for containing a non-concentrated (single-strength) product that is sufficiently rigid and stable enough to allow a consumer to use the pouch as a self-standing drinking cup.

Yet another object of the present invention is to provide a flexible pouch that can be readily opened without having to use an implement such as a pair of scissors or a knife.

Another object of the present invention is to provide a flexible pouch for containing a concentrated product that is rigid enough to provide a constant, predetermined volume for accurate fluid measurement and yet is flexible enough so that the product can be squeezed or "milked-out" from the pouch.

SUMMARY OF THE INVENTION

Self-expanding, flexible pouches of the present invention are particularly useful in packaging concentrated products that need to be reconstituted with a fluid at the point of end use. In a preferred embodiment of the present invention, the self-expanding flexible pouch includes two superimposed sidewall panels preferably made from a barrier laminate that are sealed together along their common top and side peripheral margins. The pouch's throat area is provided with a relatively stiff, resilient extensible stay that is biased toward an expanded, generally circular or elliptical configuration but held substantially flat in a stressed mode by the pouch's top seal. At least one line of weakness is preferably located laterally across the pouch's sidewall panels between the pouch's top seal and the extensible stay.

In a particularly preferred embodiment of the present invention, the bottom portion of the pouch is provided with a bottom gusset panel whose peripheral edges are attached to the inner surface of the sidewall panels. The gusset panel's midsection is folded into a pleated arrangement and extends freely up into the interior of the pouch.

In use, a consumer grasps the pouch and removes the pouch's top portion with a scissors or other utensil, or tears the pouch along the line of weakness if so provided. When the pouch's top portion is removed, the extensible stay self-expands to its unstressed configuration which spreads the pouch's throat area into a generally flattened tubular configuration. After the pouch's contents are emptied into a large container, the consumer uses the now empty pouch as the means for measuring the amount of reconstituting fluid that needs to be added. When this fluid is placed within the pouch, the pouch's throat area further expands to a generally tubular configuration while the pouch's bottom gusset panel unfolds and allows the pouch's bottom section to also expand into a generally tubular configuration. The pouch overall has then assumed a predetermined, generally tubular configuration with a predictable and repeatable internal volume such that it can be conveniently used as the means for accurately measuring the amount of fluid necessary for properly reconstituting the concentrated product.

Self-expanding pouches of the present invention are also particularly useful in packaging non-concentrated, i.e., single-strength products such as liquid fruit juice beverages. When the pouch's top section is removed, the pouch's throat area and bottom portion expand to give the pouch an overall tubular configuration from which a consumer may conveniently drink the beverage contained therein.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

FIG. 1 is a schematic, perspective view of a flexible pouch of the present invention shown with some of the pouch's internal features illustrated in phantom;

FIG. 2 is a schematic, cross-sectional side view of the flexible pouch illustrated in FIG. 1 taken along section line 2—2;

FIG. 3 is a schematic, cross-sectional side view of the flexible pouch illustrated in FIG. 1 taken along line 2—2 except that it is shown with the pouch's top section removed and in its expanded configuration;

FIG. 4 is an enlarged partial schematic, perspective view of the bottom gusset portion of a flexible pouch shown in its expanded configuration;

DETAILED DESCRIPTION OF THE INVENTION

Figure 5A:
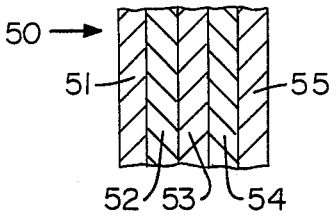
FIG. 5A is an enlarged partial schematic, cross-sectional view of a barrier film laminate from which the sidewall panels of pouches of the present invention are preferably made.

It should be noted that although the following detailed description and illustration are generally directed to flexible pouches for containing a concentrated product such as a citrus or other fruit juice concentrate, the present invention may be applied with equal facility in containing other types of concentrated and unconcentrated products such as, but not limited to, dry or powdered beverages, liquid or frozen single-strength beverages, food products such as dry soups, dry and instant cereals, and other dry foodstuffs; medications, cold remedies, mouthwashes, baking mixes, laundry soaps and softeners, adhesives, paints, hard surface cleaners, and cements.

With reference to the drawings wherein the same numeral is used to indicate common components, FIGS. 1 and 2 illustrate a self-expanding flexible pouch of the present invention generally indicated as 10 that includes flexible sidewall panels 12 and 14 which are superimposed over one another and sealed together, e.g., heat-sealed, along side peripheral edges 16 and 17 to form side seals 18 and 19, respectively, and along top peripheral edge 20 to form top seal 21. Bottom peripheral edges 22 and 24 of sidewall panels 12 and 14, respectively, can also be sealed to one another to form a bottom seal and thereby complete a closed pouch structure. However, in the particularly preferred embodiment of the present invention illustrated in FIGS. 1 and 2, bottom gusset panel 26 (shown in phantom in FIG. 1) is attached to the inner surface of sidewalls 12 and 14 in bottom portion 27 of pouch 10 along generally arcuate seal lines 28 and 30, respectively, and preferably also in the area therebelow. The portion of bottom gusset panel 26 above seal lines 28 and 30 is not attached to the inner surface of sidewalls 12 and 14 such that midsection 32 of gusset 26 is free and extends up into the interior of pouch 10 in a pleated fashion as best seen in FIG. 2.

Top portion 36 of pouch 10 is preferably provided with a line of weakness 38 that extends laterally across both sidewalls 12 and 14 in close proximity to but below top peripheral seal 21. Weakness line 38 may be formed by, for example, perforating or scoring sidewalls 12 and 14 with a laser or knife either individually before sidewalls 12 and 14 are sealed together, or collectively after they have been sealed together. One or both ends of weakness line 38 preferably terminates with a notch 39, which provides a stress concentration and aids in starting a tear along weakness line 38 when pouch 10 is opened by a consumer.

In the particularly preferred embodiment of the present invention, line of weakness 38 is partially formed in various selected layers of a barrier laminate structure (to be further described herein) from which sidewall panels 12 and 14 are made. This selective weakening of various layers, preferably the outer layers, of sidewall panels 12 and 14 may be accomplished by using a beam of radiant energy emitted from, for example, a laser such as that generally described in U.S. Pat. Nos. 3,790,744 and 3,909,582, both patents being issued to the American Can Company and being incorporated herein by reference. It has been found that if line of weakness 38 is formed individually in sidewalls 12 and 14 while they are in the form of continuous running webs prior to sealing, then very strict web control should be used to ensure that the line of weakness cut in one web aligns with the other line of weakness cut in the other web when the webs are superimposed. Alternatively, it has been found that much less stringent web control can be used if two or more and preferably three lines of weakness spaced approximately 0.016 inches (0.4 mm) from one another are scored in each sidewall to ensure that one weakness line in one sidewall will substantially align with one of the weakness lines scored in the other sidewall when the webs are superimposed.

Still referring to FIGS. 1, 2 and 3, extensible stay 40 (shown in phantom in FIG. 1) is located in throat area 42 of pouch 10 and attached to the inner surface of sidewalls 12 and 14 by using, for example, heat and pressure, an adhesive tape, or mechanical fastening means. Stay 40, which will be later described in detail, is preferably made of a relatively stiff, resilient material having a memory such as nylon. The term "memory" is intended to mean the phenomenon where a material returns to its original, unstressed configuration after having been deformed to a stressed configuration and the deforming force has been removed. When extensible stay 40 is secured inside sealed pouch 10 as shown in FIGS. 1 and 2, top seal 21, sidewalls 12 and 14, and the upper portions of side seals 18 and 19 cooperate in holding extensible stay 40 in its collapsed, stressed configuration.

Pouch 10 assumes a generally flat configuration after it has been formed, filled, and sealed as shown in FIGS. 1 and 2. In use, a consumer grasps pouch 10 and removes top portion 36 by tearing sidewalls 12 and 14 along line of weakness 38. After top portion 36 has been removed from pouch 10 as shown in FIG. 3, extensible stay 40 expands outwardly to its unstressed configuration which is preferably circular or elliptical in shape. This self-expanding action of extensible stay 40 causes throat area 42 of pouch 10 to open up and expand into a generally flattened tubular configuration without a consumer having to insert his fingers or a utensil into throat area 42 to pry sidewalls 12 and 14 apart. The consumer then pours or "milks out" the concentrated product contained within pouch 10 into a large container and then uses pouch 10 to accurately measure the amount of fluid that needs to be added to the large container for proper reconstitution. Alternatively, in the case of a single-strength concentrated beverage, the consumer leaves the concentrated product in the pouch and simply fills the pouch with the reconstituting fluid. In either case, when a fluid is placed inside pouch 10, bottom gusset panel 26 unfolds and drops downward such that midsection 32 assumes a generally planar configuration, as shown in FIGS. 3 and 4. Simultaneously, the fluid within pouch 10 further expands throat area 42, and also expands the lower portion of flexible sidewalls 12 and 14 such that, combined with the unfolding and expanding action of bottom gusset 26, bottom portion 28 of pouch 10 expands into a generally tubular configuration. Pouch 10 has then expanded into a predetermined, generally tubular configuration with a predictable and repeatable internal volume such that it can be conveniently used as the means for accurately measuring the amount of fluid necessary for properly reconstituting the concentrated product. In addition, spread-apart bottom peripheral edges 22 and 24 of sidewalls 12 and 14, respectively, cooperate to provide a stable base upon which pouch 10 is able to stand on its own on a flat surface.

Self-expanding flexible pouches of the present invention are also particularly useful in containing non-concentrated products, i.e., products which do not require a reconstituting fluid to be added, and therefore can be consumed or used directly from the pouch. For example, the present invention contemplates packaging a single-strength, non-concentrated product such as a fruit juice beverage in pouch 10 that has line of weakness 38 in sidewall panels 12 and 14 superimposed over the upper edge of extensible stay 40. In use, a consumer removes the top portion 36 along weakness line 38 with the upper edge of extensible stay 40 then providing a rigid upper edge similar to that of a drinking cup. Removing top portion 36 allows extensible stay 40 to expand throat area 42 while the air entering pouch 10 expands bottom gusset panel 26. Pouch 10 can then be used as a stable drinking cup from which a consumer may drink from directly.

Sidewall panels 12 and 14 can be made from a wide variety of materials that meet certain preferred specifications. For example, sidewalls 12 and 14 are preferably thin to reduce the amount of material used and the associated cost while being sufficiently thick and tough enough to resist punctures and leaks caused by abrasion and tough handling. In addition, sidewalls 12 and 14 are preferably made of materials that are rigid enough to allow a consumer to grasp the pouch without significantly deforming or collapsing the pouch's sidewall panels, because deforming or collapsing would make pouch 10 difficult to grasp if used as a drinking cup, and would significantly change the internal volume of the pouch and therefore make the fluid measurement less accurate in the case of reconstituting a concentrated product. Sidewalls 12 and 14 are also preferably selected from materials that can be easily handled, formed, and sealed together, preferably by heat-sealing, in a high-speed manufacturing setting by using a high-speed form, fill, and seal apparatus. Finally, sidewalls 12 and 14 are preferably made of a material or a laminate combination of materials that provides an adequate barrier against moisture, oxygen, and light which may adversely affect the performance or quality of the product contained within the pouch, particularly over an extended period of time. In the case of delicate beverages such as citrus and other fruit juices, the material selected for sidewalls 12 and 14 also preferably resists the absorption of the essential oils, flavoring components, and nutritional elements commonly found in such beverages.

FIG. 5A illustrates a partial cross-sectional view of a laminate film generally indicated as 50 that meets the above performance criteria and from which sidewalls 12 and 14 of pouch 10 can be made. In one particularly preferred embodiment of laminate film 50, layer 51, which is the outer layer of the pouch, is a 48 gauge film of polyester such as LB grade available from E. I. du-Pont de Nemours that is coated on its inner surface with a primer such as 6119-00 primer available from National Can Co., or subjected to a priming treatment such as flame, electrostatic discharge, or ultraviolet radiation, all of which improve the polyester's adhereability. Layer 52 is 14 pounds (6.4 kg) per ream low density polyethylene (LDPE) having a primer coating on its inner surface. Middle layer 53 is a 48 gauge film of polyester having a primer coating on its inner surface. Layer 54 is 14 pounds (6.4 kg) per ream LDPE. Innermost layer 55 is a 2.0 mil (0.051 mm) coextruded film of high density polyethylene (HDPE) and linear low density polyethylene (LLDPE).

In another preferred barrier laminate 50 used for making sidewall panels 12 and 14 of pouch 10, layers 52–54 are the same as previously described while outermost layer 51 is 75 gauge polyester and innermost layer 55 is a 2.0 mil (0.051 mm) coextrusion comprised of 65% HDPE/5% tie layer/10% ethylene vinylalcohol (EVOH)/5% tie/15% LLDPE. A 4 inch by 4 inch (10.2 cm × 10.2 cm) test sample of this barrier film structure 50 had an Instron stiffness of approximately 192 grams in the machine direction and 193 grams in the cross-machine direction. The tie layer resins noted above are generally polyolefin-based, interlaminar bonding agents that are used to adhere incompatible layers in laminated structures. The choice of a particular tie resin for a particular application depends on various factors such as the chemical nature of the materials being bonded, their melt viscosities, processing temperatures, and the type of laminating process and equipment being used. Examples of tie resins include the CXA family available from DuPont Chemical Company, which are essentially acid-anhydride modified ethylene vinyl acetate (EVA) multipolymers, and DuPont Elvax® 3165 ethylene vinyl acetate copolymer. Other examples of tie layer resins include the Plexar family available from Northern Petrochemical Company, which include LDPE, MDPE, HDPE, PP, and EVA copolymers.

In another particularly preferred embodiment of barrier laminate 50, outermost layer 51 is 48 gauge polyester having its inner surface coated with a primer. Layer 52 is 14 pounds (8.4 kg) per ream white LDPE having its inner surface coated with a primer. Middle layer 53 is 45 gauge oriented polypropylene (OPP) having its inner surface coated with a primer. Layer 54 is a 7 pound (4.2 kg) per ream white LDPE. Innermost product-contacting layer 55 is a 2.0 mil (0.051 mm) coextrusion comprised of HDPE and linear low density polyethylene (LLDPE).

Figure 5B:
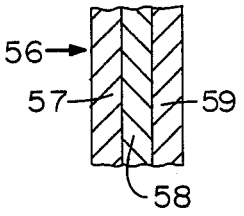
FIG. 5B is an enlarged partial schematic, cross-sectional view of a barrier film laminate from which the bottom gusset panel of pouches of the present invention are preferably made.

Bottom gusset panel 26 of pouch 10 is also preferably made from a barrier laminate film that has the aforementioned properties in addition to being slightly more flexible than sidewalls 12 and 14 so that gusset 26 will readily drop downward and expand when pouch 10 is filled with a fluid as previously described herein. In one preferred embodiment of such a barrier laminate that is illustrated in FIG. 5B and generally indicated as 56, outermost layer 57 is 48 gauge metallized polyester (metal in) primed on its inner surface, layer 58 is 7 pound (3.2 kg) per ream LDPE, and layer 59 is a 1.6 mil (0.041 mm) coextrusion of HDPE and LLDPE. In another preferred embodiment, laminate 56 is the same as just described except outer layer 57 is a non-metallized polyester. Alternatively, it has been found that a 2.5 mil (0.064 mm) film of coextruded HDPE and LLDPE works well in meeting the above-noted performance specifications.

Figure 6A:
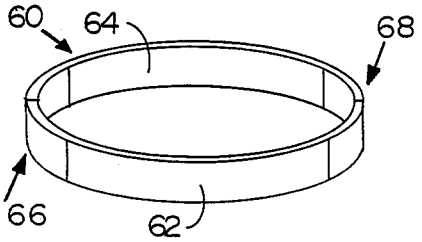
FIG. 6A is an enlarged schematic, perspective view of a particularly preferred embodiment of an extensible stay that is used in pouches of the present invention.
Figure 6B:
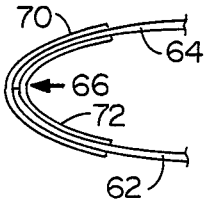
FIG. 6B is an enlarged partial schematic top view of the hinge portion of the extensible stay illustrated in FIG. 6A.

Referring now to FIG. 6A, extensible stay generally indicated as 60 is of two-piece construction and includes half stay members 62 and 64 whose opposed ends are held together in a butt joint arrangement by hinges generally indicated as 66 and 68. In FIG. 6B. hinge 66 is also preferably of two-piece construction that includes outer hinge member 70 and inner hinge member 72, both preferably being made of thin strips, e.g., 2.5 mil (0.064 mm), of linear low density polyethylene. Inner and outer half hinge members 70 and 72 are attached, e.g., heat-sealed or glued, to the inner and outer surfaces of half stay members 62 and 64 such that outer and inner hinge members 70 and 72 bridge the butt joint. Half stay members 62 and 64 are both preferably made of a resilient material such as a strip of nylon 20 mils (0.51 mm) thick. It has been found that such a material not only provides the expanding action necessary to open throat area 42 of pouch 10, but also provides the pouch with a reinforced area that will not significantly collapse when a consumer grasps the pouch.

Figure 6C:
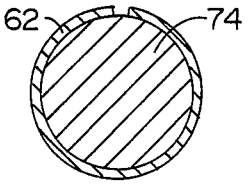
FIG. 6C is an enlarged schematic cross-sectional view of one half of the extensible stay illustrated in FIG. 6A, shown being formed on a forming apparatus.

Referring now to FIG. 6C, half stay member 62 can be formed over forming apparatus or mandrel 74 to bias it toward a circular configuration. For a 20 mil thick nylon stay, forming mandrel 74 is preferably heated from about 300° F. (149° C.) to about 360° F. (182° C.) and half stay member 62 is held in contact therewith for about 1 minute, followed by immediately quenching half stay member 62 in cold water and coating it with an emulsion sealant. Half hinge members 70 and 72 can be attached to half stay members 62 and 64 by using a sealing die set at 230° F. (110° C.), one second dwell. Forming half stay members 62 and 64 in this manner provides the expanding or spring-action necessary to expand throat area 42 of pouch 10 when top portion 36 is removed. Alternatively, stay 60 can be of one-piece, continuous construction and made by injection molding or by cutting stay 60 from a continuous tube of extruded material.

Figure 7A:
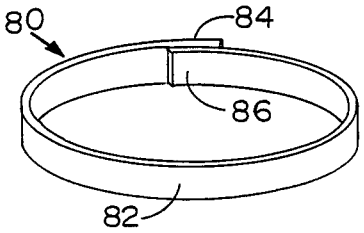
FIG. 7A is an enlarged schematic, perspective view of another particularly preferred embodiment of an extensible stay that is used in pouches of the present invention.
Figure 7B:
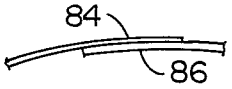
FIG. 7B is an enlarged partial schematic top view of the overlap portion of the extensible stay illustrated in FIG. 7A.
Figure 7C:
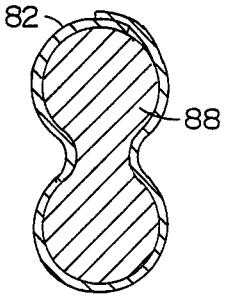
FIG. 7C is an enlarged schematic, cross-sectional view of the extensible stay illustrated in FIG. 7A, shown being formed on a forming apparatus.
Figure 8:
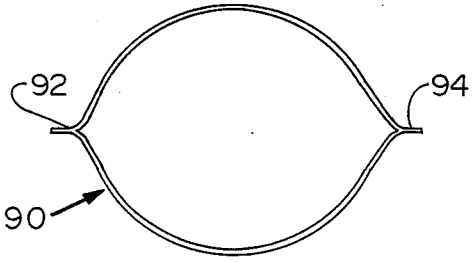
FIG. 8 is an enlarged schematic, cross-sectional view of yet another particularly preferred embodiment of an extensible stay that is used in pouches of the present invention.

FIG. 7A illustrates another particularly preferred extensible stay generally indicated as 80. Stay 80 is of one piece construction and includes stay member 82 whose opposed ends 84 and 86 are joined together, e.g., heat-sealed or glued, in overlap relation as shown in FIG. 7B. Stay member 82 is also made of a resilient material such as a strip of nylon 20 mils (0.51 mm) thick. Referring to FIG. 7C, stay member 82 can be given its expanding or spring-like action by placing it over "double shotgun barrel" forming mandrel 88 heated at from 300° F.–360° F. (149° C.–182° C.) and holding stay member 82 in contact therewith for approximately 1 minute, followed immediately by water quenching. Alternatively, stay 80 can be of one-piece, continuous construction and made by injection molding or by cutting stay 80 from a continuous tube of extruded material.

FIG. 9 illustrates yet another particularly preferred extensible stay generally indicated as 90. Stay 90 is of one-piece, continuous construction and can be made by simply cutting individual pieces from a continuous tube of extruded thermoplastic material. Stay 90 is preferably provided with opposed ears 92 and 94 which are sealed between sidewall panels 12 and 14 when pouch 10 is made to securely hold stay 90 within throat area 42 of pouch 10.

EXAMPLE

The following example describes how a self-expanding pouch of the present invention for containing 8 ounces (237 ml) of a 5:1 soft-frozen orange juice concentrate was made.

Two sidewall panels 12 and 14 were cut from barrier laminate rollstock that was previously provided with triple line of weakness 38, each panel piece being approximately 8 inches (17.8 cm) long and 4⅜ inches (11.11 cm) wide. After lines of weakness 38 in each panel were aligned and the two panels superimposed over one another, the top peripheral edges of sidewalls 12 and 14 were temporarily heat-sealed together. Next, a piece from rollstock of bottom gusset material 26 that was approximately 3 inches (7.6 cm) long and 4⅜ inches (11.1 cm) wide was heat-sealed along the bottom edge of the inner surfaces of sidewalls 12 and 14 with a heat-sealing die set at 285° F. (141° C.) and a 1 second dwell. Next, the temporary top seal was removed by cutting approximately 1 inch (2.5 cm) off the top of sidewalls 12 and 14 which left them 7 inches (17.8 cm) long. Bottom gusset 26 was folded in half (pleated) with midsection 32 fully extending up into pouch 10. Side seals 18 and 19 were then made (with the lateral edges of gusset 26 pinched therebetween) with a 3/16 inch (0.48 cm) sealing die set at 275° F. (135° C.), 1 second dwell, followed by die cutting notches 39 at both ends of weakness line 38. A 20 mil (0.51 mm) thick by 1.5 inches (3.8 cm) wide by 4 inches (10.2 cm) long extensible stay 40, which was made in accordance with the description accompanying FIGS. 6A–6C, was then inserted into the open top portion of the partially-completed pouch until the upper edge of stay 40 was within the throat area of the pouch approximately 1⅛ inches (2.9 cm) below the top edges of sidewalls 12 and 14. Stay 40 was held in this position by applying a heating die set at 300° F. (149° C.) lightly to the outer surface of sidewalls 12 and 14 in the area corresponding to stay hinges 66 and 68. Finally, the pouch was filled with approximately 8 ounces (237 ml) of soft-frozen juice concentrate and heat-sealed across the top with a ¼ inch (6.4 mm) sealing set at 275° F. (135° C.) at 40 psig for ½ second dwell.

The above-noted barrier laminate rollstock used in making the pouch's sidewall panels was comprised of five layers of thermoplastic film. The first (outer) layer was 75 gauge LB polyester. The second layer was 14 pounds (8.4 kg) per ream white pigmented LDPE. The third layer was 48 gauge LB polyester. The fourth layer was 14 pounds (8.4 kg) per ream PE pigmented with a blend of chocolate (mixture of iron oxide, titanium dioxide, and carbon black) and white pigments. The fifth (inner) layer was a 2.0 mil (0.051 mm) coextrusion comprised of 1.04 mil (0.026 mm) HDPE pigmented orange (blend of iron oxide, titanium dioxide, chromium oxide green, and isoindoline yellow), 0.13 mil (0.003 mm) tie layer, 0.20 mil (0.0051 mm) EVOH, 0.13 mil (0.003 mm) tie layer, and 0.50 mil (0.013 mm) LLDPE.

The above-noted barrier laminate rollstock used in making the pouch's bottom gusset panel was comprised of three layers of thermoplastic film. The first (outer) layer was 48 gauge LBT metallized polyester (metal in). The second layer was 7 pounds (3.2 kg) per ream LDPE. The third (inner) layer was 1.6 mil (0.041 mm) coextrusion of orange pigmented HDPE, clear HDPE, and LLDPE.

While several particularly preferred embodiments of the present invention have been described and illustrated, it should now be apparent to those skilled in the art that various changes and modifications can be made without departing from the spirit and scope of the invention. Accordingly, the following claims are intended to embrace such changes, modifications, and areas of application that are within the spirit and scope of this invention.

What is claimed is:

1. A sealed, self-expanding, flexible pouch having a top portion and a throat area subjacent said top portion, said pouch comprising:

(a) front and back sidewall panels superimposed over one another and sealed together along their top, side, and bottom peripheral edges, said panels having an inner surface; and (b) an extensible stay attached to said inner surface of said front and back sidewall panels and located in said throat area of said pouch, said extensible stay having a relaxed, expanded configuration and a stressed, collapsed configuration, said stay initially being held in its said stressed, collapsed configuration by said top portion of said pouch, whereby said stay expands to its said relaxed, expanded configuration when said top portion of said pouch is removed, thereby expanding said throat area of said pouch.

2. A self-expanding, flexible pouch having a top portion and a throat area, said pouch comprising:

(a) front and back sidewall panels superimposed over one another and sealed together along their top, side, and bottom peripheral edges, said panels having an inner surface;

(b) an extensible stay attached to said inner surface of said front and back sidewall panels and located in said throat area of said pouch, said extensible stay having a relaxed, expanded configuration and a stressed, collapsed configuration, said stay initially being held in its said stressed, collapsed configuration by said top portion of said pouch, whereby said stay expands to its said relaxed, expanded configuration when said top portion of said pouch is removed, thereby expanding said throat area of said pouch; and (c) at least one line of weakness in said front and said back sidewall panels located below said top peripheral seal.

3. The self-expanding, flexible pouch recited in claim 2 wherein at least one end of said at least one line of weakness terminates with a stress concentrating notch.

4. The self-expanding, flexible pouch recited in claim 1 wherein said extensible stay comprises two half stay members having opposed ends held together in butt relationship by hinges.

5. The self-expanding, flexible pouch recited in claim 1 wherein said extensible stay comprises a one-piece stay member having opposed ends attached together in a butt or overlap relationship.

6. The self-expanding, flexible pouch recited in claim 1 wherein said extensible stay comprises a continuous one-piece stay member being made by injection molding or extruding a thermoplastic material.

7. The self-expanding, flexible pouch recited in claim 1 wherein said front and back sidewall panels are made from a laminate comprised of layers of barrier films.

8. The self-expanding, flexible pouch recited in claim 2 wherein said front and back sidewall panels are made from a laminate comprised of layers of barrier films and wherein said at least one line of weakness does not extend through the innermost layer of barrier film of said laminate.

9. The self-expanding, flexible pouch recited in claim 7 wherein said layers of barrier films are selected from the group consisting of polyesters, polyethylenes, polypropylenes, ethylene vinyl alcohol, and mixtures, copolymers, and coextrusions thereof.

10. A sealed, self-expanding, flexible pouch having a top portion, a throat area subjacent said top portion, and a bottom portion, said pouch comprising:

(a) front and back sidewall panels superimposed over one another and sealed together along their top and side peripheral edges, said panels having an inner surface;

(b) an extensible stay attached to said inner surface of said front and back sidewall panels and located in said throat area of said pouch, said extensible stay having a relaxed, expanded configuration and a stressed, collapsed configuration, said stay initially being held in its said stressed, collapsed configuration by said top portion of said pouch, whereby said stay expands to its said relaxed, expanded configuration when said top portion of said pouch is removed, thereby expanding said throat area of said pouch; and (c) a bottom gusset panel attached to said inner surface of said front and back sidewall panels in said bottom portion of said pouch, said gusset panel initially being folded up into said pouch in a pleated arrangement, said gusset panel unfolding and expanding when a fluid is poured into said pouch, thereby expanding said bottom portion of said pouch into a substantially tubular configuration.

11. A self-expanding, flexible pouch having a top portion, a throat area, and a bottom portion, said pouch comprising:

(a) front and back sidewall panels superimposed over one another and sealed together along their top and side peripheral edges, said panels having an inner surface;

(b) an extensible stay attached to said inner surface of said front and back sidewall panels and located in said throat area of said pouch, said extensible stay having a relaxed, expanded configuration and a stressed, collapsed configuration, said stay initially being held in its said stressed, collapsed configuration by said top portion of said pouch, whereby said stay expands to its said relaxed, expanded configuration when said top portion of said pouch is removed, thereby expanding said throat area of said pouch;

(c) a bottom gusset panel attached to said inner surface of said front and back sidewall panels in said bottom portion of said pouch, said gusset panel initially being folded up into said pouch in a pleated arrangement, said gusset panel unfolding and expanding when a fluid is poured into said pouch, thereby expanding said bottom portion of said pouch into a substantially tubular configuration; and (d) at least one line of weakness in said front and said back sidewall panels located below said top peripheral seal.

12. The self-expanding, flexible pouch recited in claim 11 wherein the ends of said at least one line of weakness terminate with a stress concentrating notch.

13. The self-expanding, flexible pouch recited in claim 10 wherein said extensible stay comprises two half stay members having opposed ends held together in butt relationship by hinges.

14. The self-expanding, flexible pouch recited in claim 10 wherein said extensible stay comprises a one piece stay member having opposed ends attached together in a butt or overlap relationship.

15. The self-expanding, flexible pouch recited in claim 10 wherein said extensible stay comprises a continuous one-piece stay member being made by injection molding or extruding a thermoplastic material.

16. The self expanding, flexible pouch recited in claim 10 wherein said front and back sidewall panels are made from a laminate comprised of layers of barrier films.

17. The self-expanding, flexible pouch recited in claim 11 wherein said front and back sidewall panels are made from a laminate comprised of layers of barrier films and wherein said at least one line of weakness does not extend through the innermost layer of barrier film of said laminate.

18. The self-expanding, flexible pouch recited in claim 10 wherein said bottom gusset panel is made from a laminate comprised of layers of barrier films 19. The self-expanding, flexible pouch recited in claim 16 wherein said layers of barrier films are selected from the group consisting of polyesters, polyethylenes, polypropylenes, ethylene vinyl alcohol, and mixtures, copolymers, and coextrusions thereof.

20. The self-expanding, flexible pouch recited in claim 18 wherein said layers of barrier films are selected from the group consisting of polyesters, polyethylenes, polypropylenes, ethylene vinyl alcohol, and mixtures, copolymers, and coextrusions thereof.

21. A sealed flexible pouch having a throat portion which expands upon opening said pouch, said pouch comprising flexible confronting front and back sidewall panels, a top portion, and said throat portion, said throat portion being disposed subjacent said top portion, said pouch further comprising top sealing means which extends across said top portion, and means for biasing said throat portion to spread it open upon removal of said top portion.

22. The sealed flexible pouch of claim 21 further comprising a bottom gusset panel of flexible material, said gusset panel being initially pleated and disposed between bottom portions of said front and back sidewall panels, said flexible material being sufficiently flexible to unfold when fluid is poured into said pouch so that the bottom portion of said pouch then expands to a somewhat tubular shape.

23. The sealed flexible pouch of claim 21 or 22 further comprising integral means for enabling tear removal of said top portion to open said pouch, and so that said throat portion is then expanded by said means for biasing.

24. The sealed flexible pouch of claim 23 wherein said integral means for enabling tear removal of said top portion comprises at least one line of weakness disposed in said panels.

25. The sealed flexible pouch of claim 21 or 22 wherein said means for biasing comprises a resilient stay having a relaxed, expanded configuration, and a stressed, collapsed configuration, said stay being held in its collapsed configuration by other pouch structure until said top portion is removed whereupon it expands to its unstressed configuration and thereby expands said throat portion of said pouch.

26. The sealed flexible pouch of claim 25 further comprising integral means for enabling tear removal of said top portion to open said pouch, and so that said throat portion is then expanded by said means for biasing.

27. The sealed flexible pouch of claim 26 wherein said integral means for enabling tear removal of said top portion comprises at least one line of weakness disposed in said panels.

* * * * *